US007224287B2

(12) United States Patent
Heider et al.

(10) Patent No.: US 7,224,287 B2
(45) Date of Patent: May 29, 2007

(54) METHOD FOR DETERMINING THE SWITCHING STATE OF A CONTACT AND EVALUATION CIRCUIT CORRESPONDING THERETO

(75) Inventors: Peter Heider, Schwandorf (DE); Diethard Runggaldier, Stegaurach (DE); Bernhard Streich, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 539 days.

(21) Appl. No.: 10/497,155

(22) PCT Filed: Nov. 14, 2002

(86) PCT No.: PCT/DE02/04226

§ 371 (c)(1),
(2), (4) Date: May 28, 2004

(87) PCT Pub. No.: WO03/049128

PCT Pub. Date: Jun. 12, 2003

(65) Prior Publication Data

US 2005/0007254 A1 Jan. 13, 2005

(30) Foreign Application Priority Data

Nov. 28, 2001 (DE) ..... 101 58 316

(51) Int. Cl.
*G08B 21/00* (2006.01)

(52) U.S. Cl. ..... 340/644; 340/635; 340/652; 361/1

(58) Field of Classification Search ..... 340/644, 340/652, 657, 660, 635, 691.6; 361/1, 14, 361/115; 307/112
See application file for complete search history.

(56) References Cited

U.S. PATENT DOCUMENTS

| | | | | |
|---|---|---|---|---|
| 4,249,223 | A | 2/1981 | Shuey et al. | 361/4 |
| 4,420,784 | A * | 12/1983 | Chen et al. | 361/7 |
| 4,777,479 | A | 10/1988 | Hinckley | 340/644 |
| 5,455,733 | A * | 10/1995 | Waggamon | 361/115 |
| 5,475,371 | A * | 12/1995 | Dunk et al. | 340/660 |
| 6,198,611 | B1 * | 3/2001 | Macbeth | 361/42 |
| 6,388,849 | B1 * | 5/2002 | Rae | 361/42 |

FOREIGN PATENT DOCUMENTS

| | | |
|---|---|---|
| DE | 40 28 721 C2 | 3/1992 |
| DE | 199 44 461 C1 | 1/2001 |
| DE | 100 25 276 A1 | 12/2001 |

OTHER PUBLICATIONS

Ulrich Tietze and Christoph Schenk: Halbleiter-Schaltungstechnik, pp. 852-861.

* cited by examiner

*Primary Examiner*—Phung T. Nguyen
(74) *Attorney, Agent, or Firm*—Harness, Dickey & Pierce, P.L.C.

(57) ABSTRACT

An input voltage contacted at the input of a contact can be through-connected to an output of the contact or switched off via a movable contactor. In order to determine the switching state of the contact, any drop in the contact voltage between the input and the output is detected. By the detected contact voltage, it can at least be determined whether the input voltage has been through-connected to the output or switched off.

14 Claims, 1 Drawing Sheet

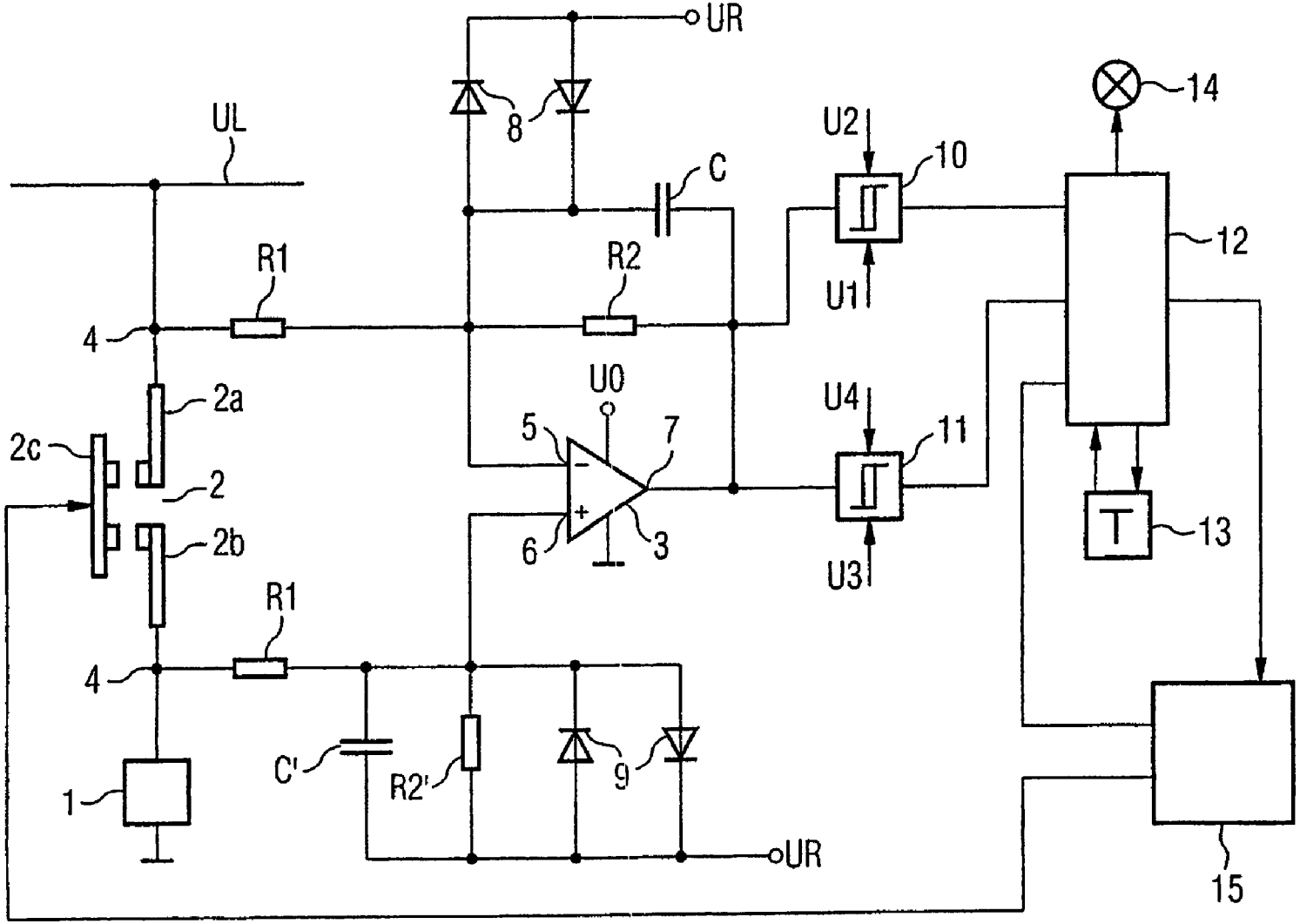
14
12
13
15
10
11
U2
U1
U4
U3
UR
C
R2
U0
7
3
5
6
8
9
R2'
C'
UR
UL
R1
R1
2a
2
2b
2c
4
4
1

METHOD FOR DETERMINING THE SWITCHING STATE OF A CONTACT AND EVALUATION CIRCUIT CORRESPONDING THERETO

This application is the national phase under 35 U.S.C. § 371 of PCT International Application No. PCT/DE02/04226 which has an International filing date of Nov. 14, 2002, which designated the United States of America and which claims priority on German Patent Application number DE 101 58 316.8 filed Nov. 28, 2001, the entire contents of which are hereby incorporated herein by reference.

FIELD OF THE INVENTION

The present invention generally relates to a method for determining the switching state of a contact, via which an input voltage, applied to an input of the contact, can be passed on via a moving switching piece to an output of the contact and can be disconnected from it. An evaluation circuit preferably records a contact voltage that is dropped between the input and the output, and the recorded contact voltage is preferably used to determine at least whether an arc is occurring between the switching piece and the input and/or the output. It also generally relates to a corresponding evaluation circuit.

BACKGROUND OF THE INVENTION

A determination method and an evaluation circuit are known, for example, from U.S. Pat. No. 4,249,223. The evaluation circuit is used in electromagnetic switching devices, in particular in contactors and isolating switches, in order to quench arcs that occur during opening of the contact.

U.S. Pat. No. 4,777,479 discloses a determination method for a switching state of a contact, via which an input voltage which is applied to an input of the contact can be passed on via a moving switching piece to an output of the contact, or can be disconnected from it. In this case, the method determines whether the input voltage is or is not being passed on to the output. The recorded nominal state is indicated.

The prior, not previously published, DE 100 25 276.1, describes a method for determining the switching state of a contact, via which an input voltage which is applied to an input of the contact can be passed on via a moving switching piece to an output of the contact, or can be disconnected from it. In this case as well, a contact voltage which is dropped between the input and the output is recorded, and the recorded contact voltage is used to determine whether the input voltage has or has not been disconnected from the input.

SUMMARY OF THE INVENTION

An object of an embodiment of the present invention is to provide a determination method and a corresponding evaluation circuit, by which the contact can be operated more reliably and more safely.

An object may be achieved in that the evaluation circuit also determines whether the input voltage is passed on to the output or is disconnected from it. Further, a contact which is arranged upstream of the contact is opened if an arc occurs for a relatively long time. This is because this makes it possible to avoid the arc damaging the contact if it is not itself quenched sufficiently quickly, or is not quenched.

It is admittedly already known from the prior, not previously published DE 100 25 276.1 for the contact voltage to be recorded and evaluated. In this prior application, however, the evaluation is used only for recording an arc voltage, that is to say in particular not to distinguish whether the input voltage is passed on to the output or is disconnected from it.

The recorded contact voltage is preferably also used to determine whether an arc is occurring between the switching piece and the input and/or between the switching piece and the output. This is because, in particular, it is possible to determine the switching time when a switching state change occurs. The erosion of a contact face can then be deduced from the switching time. Furthermore, it is also possible to record whether an arc has occurred for a lengthy time. In particular, if an arc has occurred for a lengthy time, a contact arranged upstream of the contact can be opened, thus preventing the arc from causing damage to the contact.

If the specific switching state is used to determine a signal which is emitted when the signal assumes the same value for a relatively long time, short-term disturbances and transient states during a change in the switching state, in particular, do not influence the emitted signal.

The emitted signal may itself correspond to the switching state. However, it is also possible to compare the specific signal state with a nominal state in order to determine the signal. In this case, the signal is a fault signal.

The signal may be emitted in a form in which it can be perceived directly by a person, by way of his sensory organs. Examples of signals such as these are acoustic and, in particular, optical signals. Alternatively or additionally, the signal may, however, also be passed on to a control unit which is at a higher level than the contact.

BRIEF DESCRIPTION OF THE DRAWINGS

Further advantages, features and details of the invention will become evident from the description of illustrated embodiments given hereinbelow and the accompanying drawings, which are given by way of illustration only and thus are not limitative of the present invention, wherein:

FIG. 1 shows a contact with an evaluation circuit.

DETAILED DESCRIPTION OF THE PREFERRED EMBODIMENTS

As is shown in FIG. 1, a load 1 can be connected to a load or input voltage UL via a contact 2. The contact 2-has an input 2*a* and an output 2*b*. The load voltage UL is permanently applied to the input 2*a*. In contrast, it can be disconnected from the output 2*b*. The load voltage UL is passed on to or disconnected from the output 2*b* by means of a moving switching piece 2*c*.

A voltage recording circuit 3 is connected to recording points 4 via recording resistors R1. One of the recording points 4 is in this case arranged on the input side and output side, respectively, of the contact 2. The voltage recording circuit 3 is connected via the recording resistors R1 to the recording points 4 with a high impedance, but permanently and conductively.

The recording resistors R1 have resistances which are typically in the range above 1 MΩ, for example 3 to 10 MΩ. They preferably have the same resistances.

The voltage recording circuit 3 is in the form of an operational amplifier 3 which has an inverting signal input 5, a non-inverting signal input 6 and a signal output 7. The operational amplifier 3 is supplied with a supply voltage U0.

The signal inputs 5, 6 are connected to the recording points 4 via the recording resistors R1 . The inverting signal input 5 is also connected via a capacitor C and a circuit resistor R2 to the signal output 7. The capacitor C and the circuit resistor R2 are arranged parallel with one another, as can be seen in this case. The non-inverting signal input 6 is also connected via a further circuit resistor R2' and a further capacitor C' to a reference voltage UR. In principle, the reference voltage UR may be chosen as required. However, it is preferably half the supply voltage U0.

The circuit resistors R2, R2' are considerably smaller than the recording resistors R1. Their resistances are typically in the range below 10 kΩ, for example 1 to 5 kΩ. They preferably have the same resistances as one another. The capacitors C, C' preferably have a relatively small capacitance, for example 10 to 470 nF.

The inverting signal input 5 is connected to the reference voltage UR via two back-to-back parallel-connected diodes 8. Furthermore, the non-inverting signal input 6 is also connected to the reference voltage UR via two further back-to-back parallel-connected diodes 9. The diodes 8, 9 are preferably identical to one another.

Owing to the circuitry of the operational amplifier 3, the reference voltage UR is produced at the signal output 7 of the operational amplifier 3 when the input voltage UL is passed on. If, in contrast, the input voltage UL is disconnected from the output 2*b*, the entire input voltage UL is dropped across the contact 2. This results in the signal that is emitted at the signal output 7 being shifted considerably upwards or downwards (depending on the mathematical sign of the input voltage UL).

If, in contrast, an arc occurs between the switching piece 2*c* and the input 2*a*, or between the switching piece 2*c* and the output 2*b*, then only an arc voltage in the order of magnitude of a few volts is dropped across the contact 2. In this case, the majority of the load voltage UL is thus still passed to the load 1.

In order to distinguish between these three states—input voltage UL passed on to the output 2*b*, input voltage UL disconnected from the output 2*b* and the occurrence of an arc—the signal output 7 is followed by two window comparators 10, 11.

The first window comparator 10 is supplied with two comparison voltages U1, U2. The two comparison voltages U1, U2 are slightly above and below the reference voltage UR, respectively. The window comparator 10 produces a positive output signal when the voltage which is emitted at the signal output 7 of the operational amplifier 3 is within the voltage window defined by the comparison voltages U1, U2. Otherwise, it produces a null signal. The comparison voltages U1, U2 are in this case chosen such that the window comparator 10 produces a positive output signal only when the input voltage UL is passed on to the output 2*b* without an arc. The window comparator 10 produces a null signal, in contrast, even when only the arc voltage is dropped.

The method of operation of the window comparator 11 corresponds to that of the window comparator 10. However, it is supplied with comparison voltages U3, U4 which are further above and below the reference voltage UR, respectively, than the comparison voltages U1, U2. The window comparator 11 therefore produces a null signal only when the contact 2 is completely open, that is to say when the load voltage UL is completely disconnected from the output 2*b*. If, in contrast, the arc voltage is dropped across the contact 2 or the contact 2 is completely closed, it produces a positive output signal.

The output signals from the two window comparators 10, 11 are supplied to a state determination circuit 12. The state determination circuit 12 then uses the output signals, supplied from the window comparators 10, 11, to determine the switching state of the contact 2. If both window comparators 10, 11 produce a positive output signal, the input voltage UL is passed on to the output 2*b*. If both window comparators 10, 11 produce a null signal, the input voltage UL is disconnected from the output 2*b*. If the window comparator 10 produces a null signal but in contrast the window comparator 11 produces a positive output signal, an arc is occurring between the switching piece 2*c* and the input 2*a* and/or between the switching piece 2*c* and the output 2*b*.

The state determination circuit 12 uses the switching state as determined in this way to determine a signal. Furthermore, it transmits a drive signal to a timer 13 whenever the output signals that are transmitted from the window comparators 10, 11 change, that is to say when the signal is redetermined. The timer 13 is in consequence set to 0 and is started. When the timer 13 reaches a time limit T, it transmits a trigger signal back to the state determination circuit 12. The timing out of the timer 13, that is to say the reaching of the time limit T. indicates that the switching state as determined by the state determination circuit 12 is the same for a relatively long time. As such, the signal has assumed the same value for a relatively long time. In this case, the determined signal is emitted from the state determination circuit 12.

Firstly, the state determination circuit 12 drives a signal transmitter 14, for example a light-emitting diode 14. If the light-emitting diode 14 illuminates, then this corresponds to the switching state in which the input voltage UL is passed on to the output 2*b*. If the light-emitting diode 14 is switched off, the input voltage UL is disconnected from the output 2*b*. If the light-emitting diode 14 blinks, then an arc is occurring. The signal is thus emitted from the state determination circuit in a form in which it can be perceived directly by a person by way of his sensory organs.

In addition to this, the signal can be passed on from the state determination circuit 12 to a control unit 15. The control unit 15 is a higher-level control unit 15 by which, in particular, the contact 2 can be controlled. According to the example explained above, the state determination circuit 12 itself emits the switching state as a signal. However, it is also feasible for the higher-level control unit 15 to transmit a nominal state for the contact 2 to the state determination circuit 12.

In this case, for example, the state determination circuit 12 can compare the switching state of the contact 2 as determined by itself with the nominal switching state, and can use this to determine a fault signal as the signal. In this case as well, the signal can once again be transmitted to the signal transmitter 14 and to the higher-level control unit 15. If the light-emitting diode 14 is blinking, this may, for example, indicate a fault situation, lack of a drive for correct operation of the light-emitting diode 14, that is to say with the nominal switching state matching the specific switching state.

The evaluation circuit according to an embodiment of the invention makes it possible to directly determine the switching state of the contact in a simple, cost-effective, safe and reliable manner. The power loss that occurs in the evaluation circuit is in this case negligible.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for determining the switching state of a contact, via which an input voltage applied to an input of the contact, can be passed on via a moving switching piece to an output of the contact and can be disconnected from it, comprising:

recording a contact voltage dropped between the input and the output;

determining, using the recorded contact voltage, at least one of whether the input voltage is passed on to the output, whether the input voltage is disconnected from the output, and whether an arc is occurring between the switching piece and at least one of the input and the output; and opening another contact, arranged upstream of the contact, upon determining an arc occurring for a relatively long time.

2. The method of claim 1, wherein the evaluation circuit is used in making the determination.

3. The method as claimed in claim 1, wherein an opening signal is emitted to control opening of the another contact.

4. The method as claimed in claim 3, wherein the specific switching state is used to determine a signal which is emitted when the signal assumes the same value for a relatively long time.

5. The method as claimed in claim 4, wherein, in order to determine the signal, the specific switching state is compared with a nominal switching state, and wherein the signal is a fault signal.

6. The method as claimed in claim 5, wherein the signal is emitted in a form in which it can be perceived directly by a person by one of his sensory organs.

7. The method as claimed in claim 3, wherein the signal is emitted in a form in which it can be perceived directly by a person by one of his sensory organs.

8. The method as claimed in claim 3, wherein the signal is passed on to a control unit which is at a higher level than the contact.

9. An evaluation circuit for the switching state of a contact, via which an input voltage applied to an input of the contact can be passed on via a moving switching piece to an output of the contact and can be disconnected from it, wherein a contact voltage dropped across the contact is recorded by the evaluation circuit, and wherein the recorded contact voltage is used by the evaluation circuit to determine at least one of whether the input voltage is passed on to the output, whether the input voltage is disconnected from the output, and whether an arc is occurring between the switching piece and at least one of the input and the output, and wherein the evaluation circuit is adapted to emit an opening signal to another contact, arranged upstream of the contact, upon determining an arc occurring for a relatively long time.

10. The evaluation circuit as claimed in claim 9, wherein the recorded contact voltage is also used to determine whether an arc occurs between at least one of the switching piece and the input, and between the switching piece and the output.

11. The evaluation circuit as claimed in claim 9, wherein the evaluation circuit uses the specific switching state to determine a signal to emit when the signal has the same value for a relatively long time.

12. The evaluation circuit as claimed in claim 11, wherein a nominal switching state for the contact is supplyable to the evaluation circuit, wherein the specific switching state is comparable by the evaluation circuit with the nominal switching state, and wherein the signal is a fault signal.

13. An evaluation circuit for the switching state of a contact, via which an input voltage applied to an input of the contact can be passed on via a moving switching piece to an output of the contact and can be disconnected front it, comprising:

means for recording a contact voltage dropped across the contact;

means for determining, using the recorded contact voltage, at least one of whether the input voltage is passed on to the output, whether the input voltage is disconnected from the output, and whether an arc is occurring between the switching piece and at least one of the input and the output; and means for controlling opening of another contact, arranged upstream of the contact, upon determining an arc occurring for a relatively long time.

14. The evaluation circuit of claim 13, wherein the means for controlling emits an opening signal to control opening of the another contact.

* * * * *